US006875013B2

(12) United States Patent
Smith

(10) Patent No.: US 6,875,013 B2
(45) Date of Patent: Apr. 5, 2005

(54) LIGHTER WITH DUAL CUTTER ASSEMBLIES

(75) Inventor: Andrew D. Smith, Pascoag, RI (US)

(73) Assignee: Colibri Corporation, Providence, RI (US)

( * ) Notice: Subject to any disclaimer, the term of this patent is extended or adjusted under 35 U.S.C. 154(b) by 0 days.

(21) Appl. No.: 10/348,086

(22) Filed: Jan. 21, 2003

(65) Prior Publication Data

US 2004/0142293 A1 Jul. 22, 2004

(51) Int. Cl.[7] ..... A24F 13/24; F23Q 2/34

(52) U.S. Cl. ..... 431/253; 131/248; 131/249

(58) Field of Search ..... 431/253; D27/141, D27/142, 143, 161; 206/238; 30/109, 111, 113, 113.3; 131/233, 248, 249, 250, 250.1, 251, 252, 253, 254, 255

(56) References Cited

U.S. PATENT DOCUMENTS

| | | | | | |
|---|---|---|---|---|---|
| 282,764 | A | | 8/1883 | Peavey | |
| 464,405 | A | * | 12/1891 | Widman | 7/118 |
| 703,162 | A | * | 6/1902 | Todd, Jr. | 131/255 |
| 1,734,620 | A | * | 11/1929 | Giacopini | 131/255 |
| D170,767 | S | * | 11/1953 | Polk | D27/142 |
| 2,828,855 | A | * | 4/1958 | Mosch | 206/234 |
| D208,425 | S | * | 8/1967 | Hocq | D27/143 |
| 4,451,229 | A | * | 5/1984 | Nitta | 431/253 |
| 5,738,117 | A | | 4/1998 | Fontaine, Jr. | |
| 5,780,813 | A | | 7/1998 | Sire et al. | |
| 5,829,965 | A | * | 11/1998 | Rubalcava | 431/253 |
| 5,888,061 | A | | 3/1999 | Reynolds | |
| D410,563 | S | * | 6/1999 | Reynolds | D27/143 |
| 5,911,573 | A | | 6/1999 | Tsai | |
| 5,913,676 | A | | 6/1999 | Kim | |
| D436,222 | S | * | 1/2001 | Lim | D27/141 |
| 6,257,873 | B1 | | 7/2001 | Song | |
| 6,298,856 | B1 | | 10/2001 | Park | |
| D459,835 | S | * | 7/2002 | Lim | D27/143 |

FOREIGN PATENT DOCUMENTS

| | | | |
|---|---|---|---|
| JP | 11141875 | | 5/1999 |
| JP | 11-141875 | * | 5/1999 |

* cited by examiner

*Primary Examiner*—Carl D. Price
(74) *Attorney, Agent, or Firm*—Salter & Michaelson

(57) ABSTRACT

A combination lighter having dual cutting assemblies for severing the end of a cigar and punching a hole therein is disclosed. The device includes a lighter body which supports a lighter mechanism, a first cutting assembly, and a second cutting assembly. The first cutting assembly may be a guillotine style cutter having a housing which supports a moveable blade. The first cutting assembly is moveable between a closed position adjacent the lighter body, and an open position where it extends from the lighter body. The second cutting assembly may be a punch style cutter having a tubular-shaped body and a cutting end for cutting an opening in the end of a cigar. The second cutting assembly may be moveable between a retracted position, where the cutting end is substantially flush with an end of the lighter body, and an operative position where the cutting end extends from the lighter body.

15 Claims, 9 Drawing Sheets

LIGHTER WITH DUAL CUTTER ASSEMBLIES

DESCRIPTION

1. Technical Field

The invention relates generally to a lighter having a pair of cutting assemblies, and more particularly, to a combination lighter and cigar cutter capable of severing the end of a cigar, punching or piercing the cigar, and lighting the cigar with a single device.

2. Background of Related Art

Cigar smoking has become a popular past time during the past decade. As cigar smoking has gained in popularity, so too have the accessories utilized to cut and light cigars. The proper tools for cutting and lighting cigars are perceived to enhance the cigar smoking experience. For example, many experienced cigar smokers will leave the head portion of the cigar in its finished, pre-smoked state until the cigar is ready to be smoked, in order to maximize the flavor and freshness of the cigar. Before smoking, the experienced cigar smoker will cut the finished head portion (i.e. the smoking end of the cigar which is placed in the user's mouth) of the cigar with a tool to provide a clean cut. It is well known in the art of cigar cutters to provide a guillotine style cutter which is used to clip the smoking end of the cigar. It is also known to provide a tubular cutter, or punch cutter, for forming a hole or opening in the smoking end of the cigar. Both types of cutters are well known in the art, as are v-shaped cutters, all of which provide a clean cut to ensure proper circulation through the body of the cigar when smoked.

Numerous lighters are also well known in the art which are utilized for lighting cigars. Since cigar smoking is largely a social function, various style lighters have been developed to suit the different tastes of cigar smokers. Some lighters also include a cutter in combination with the lighter. For example, U.S. Design Pat. No. 459,835, which is commonly assigned, discloses a combination cigarette/cigar lighter including two punch style cutters. Likewise, U.S. Pat. No. 5,738,117, which is also commonly assigned, discloses a guillotine style cutter supported by a lighter. Although the combination of a lighter with a cutter is known and desirable for its combination of two elements in a single device, continued development in the art is needed for providing additional combinations for users. While the use of punch style and guillotine type cutters are separately known in the art, both style cutters have previously been unavailable together and in combination with a lighter. In particular, the combination of dual cutters with a lighter has presented a challenge to designers because combining two different cutters with a lighter can lead to an awkward configuration which may be difficult for a user to handle and aesthetically may be unpleasing.

SUMMARY

Accordingly, it is a object of the present invention to provide a combination lighter having two different cutting assemblies for both severing the end of the cigar and/or punching a hole therein, as desired, by the user. The combination device includes a lighter body which supports a lighter mechanism, a first cutting assembly, and a second cutting assembly. The first cutting assembly may preferably be a guillotine style cutter having a housing which supports a moveable cutting blade. In one embodiment, the housing is preferably pivotally attached to the body of the lighter, such that the housing is moveable between a closed position where it is adjacent the body and an open position where it extends from the body. The blade housing may further include an opening sized to receive an end of a cigar therein, and a slot sized to slidably receive the cutting blade. In one embodiment, the cutting blade preferably includes an inclined cutting edge and a handle for moving the cutting edge into contact with the cigar when the cigar is placed within opening. The second cutting assembly may preferably be a punch style cutter having a tubular-shaped body, and including a cutting end designed to cut or punch a hole in the end of a cigar. The second cutting assembly may also be moveable between a retracted position, wherein the cutting end is substantially flush with an end of the lighter body, and an operative position where the cutting end extends from within the lighter body. In order to move the second cutting assembly between the retracted and operative positions, a knob maybe provided which extends from the tubular-shaped body and through a slot in the lighter body.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
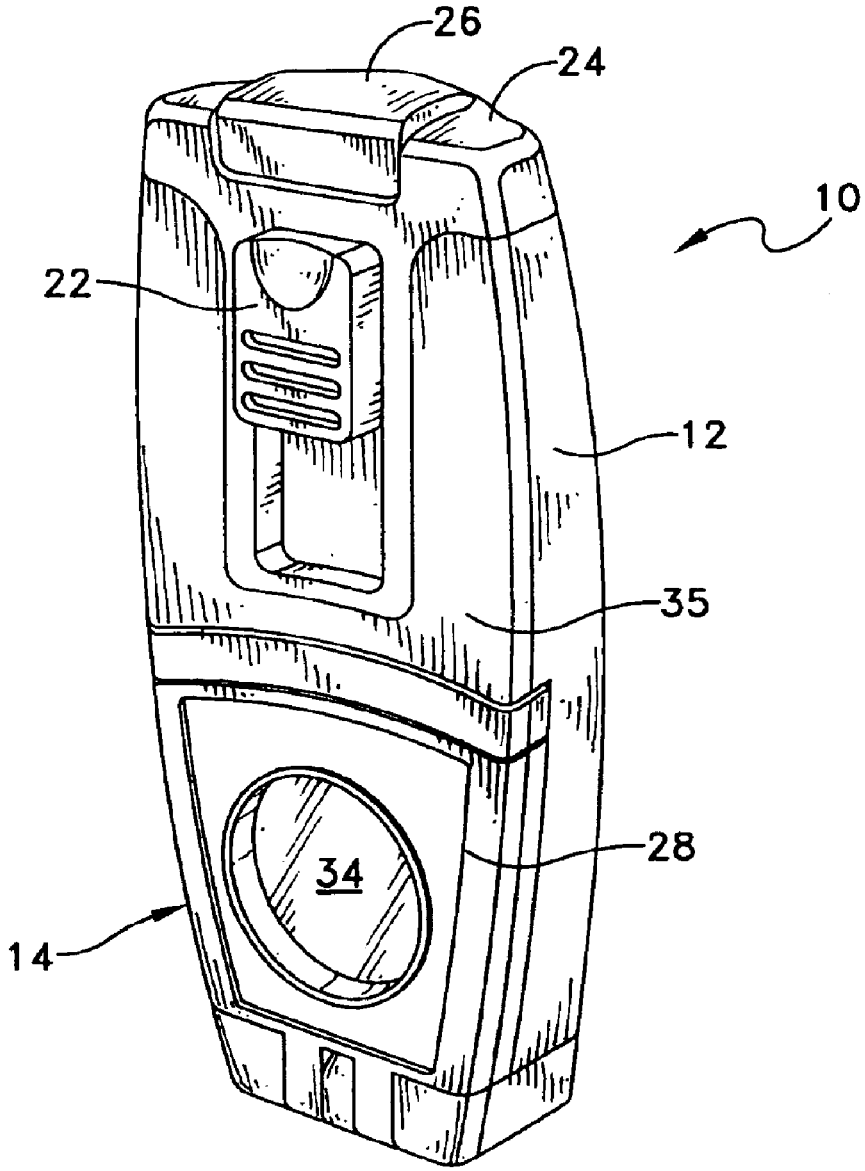
FIG. 1 is a perspective view of a combination lighter and dual cigar cutter according to a first embodiment in a closed position.
Figure 6:
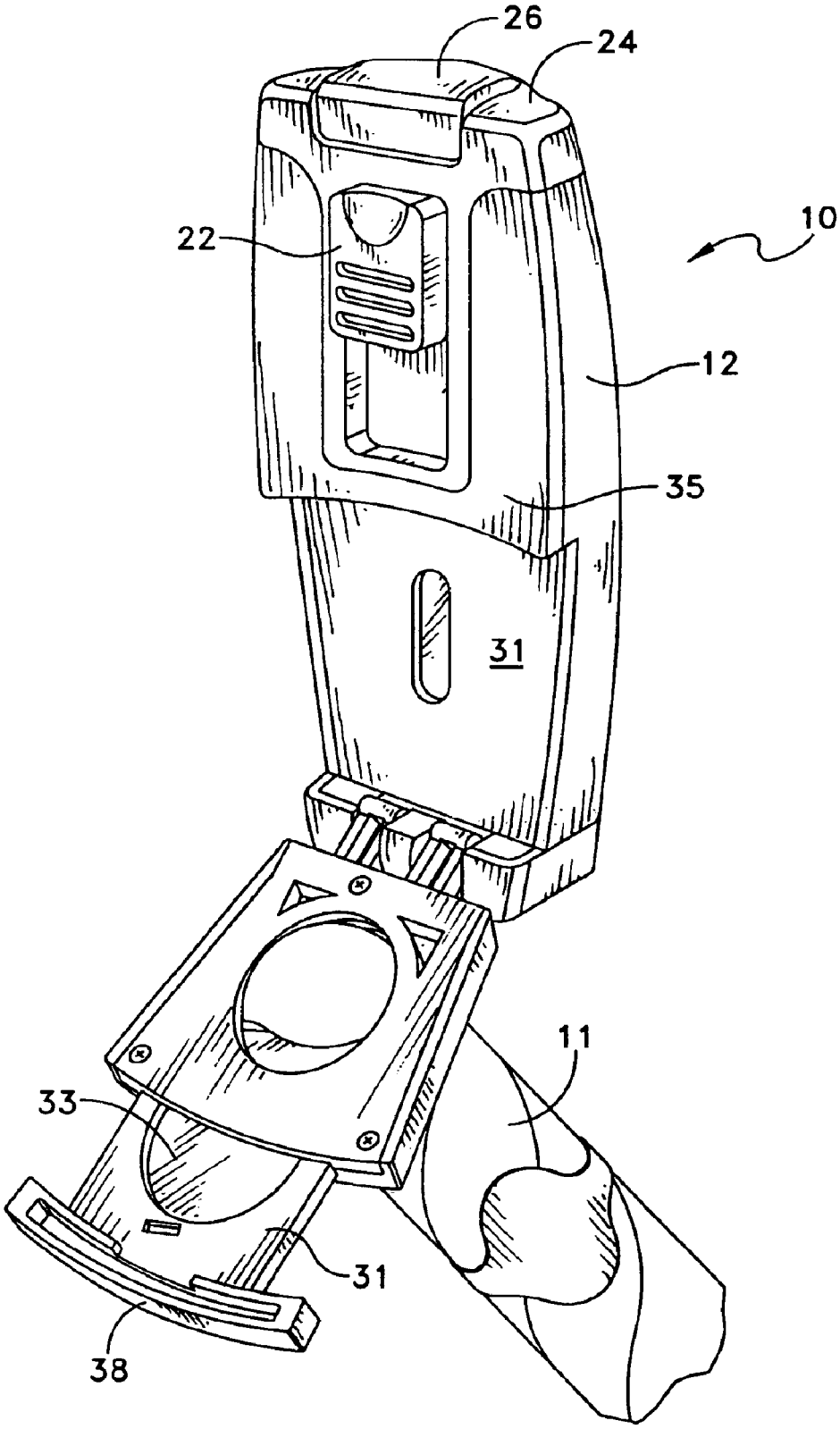
FIG. 6 is a perspective view of the embodiment of FIG. 1 with the first cutting assembly in an open position showing a head portion of a cigar having been cut.
Figure 7:
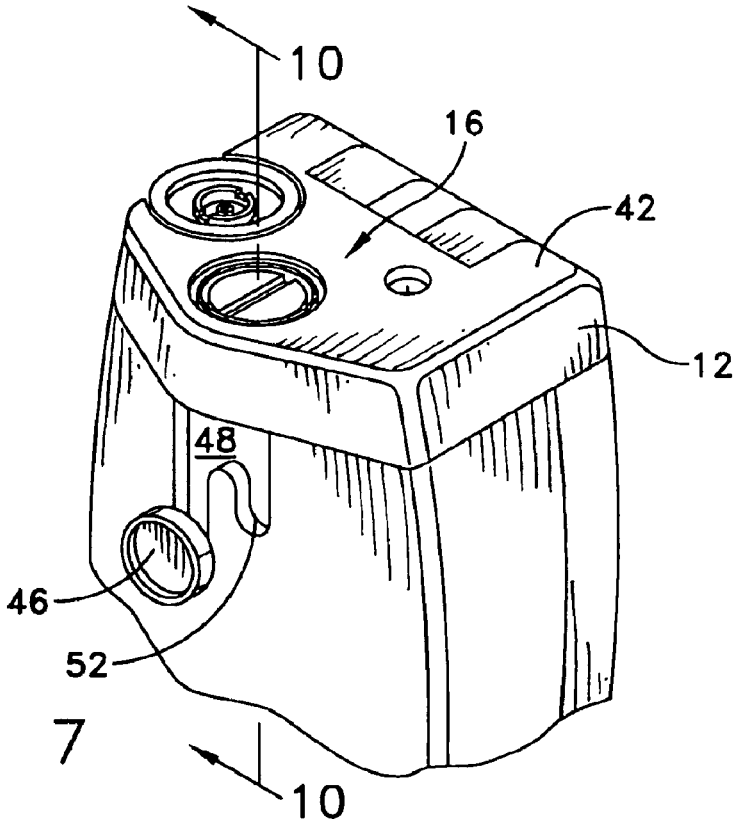
FIG. 7 is an enlarged, perspective view of one end of the combination lighter and dual cigar cutter of FIG. 1 showing a second cutting assembly in a retracted position.
Figure 8:
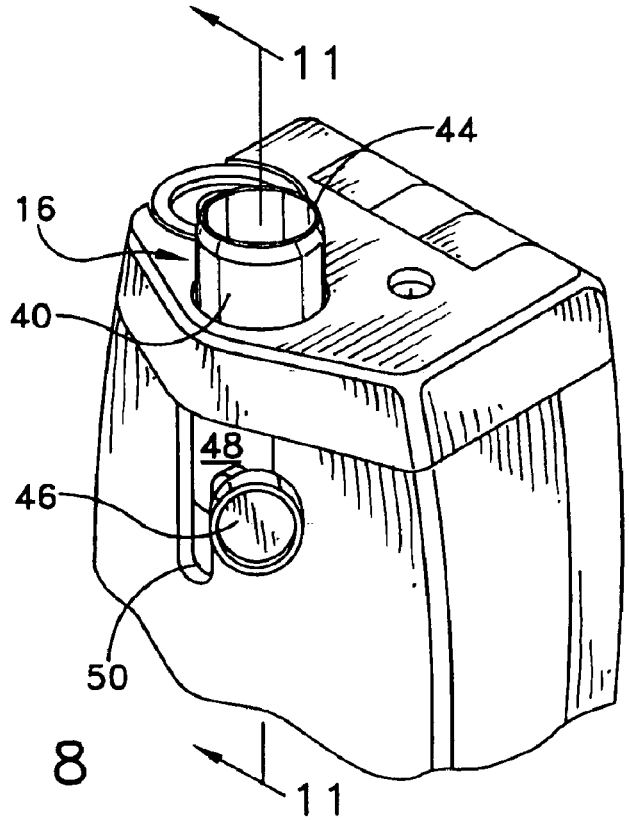
FIG. 8 is an enlarged, perspective view of one end of the combination lighter and dual cigar cutter of FIG. 1 showing the second cutting assembly in an actuated position.
Figure 9:
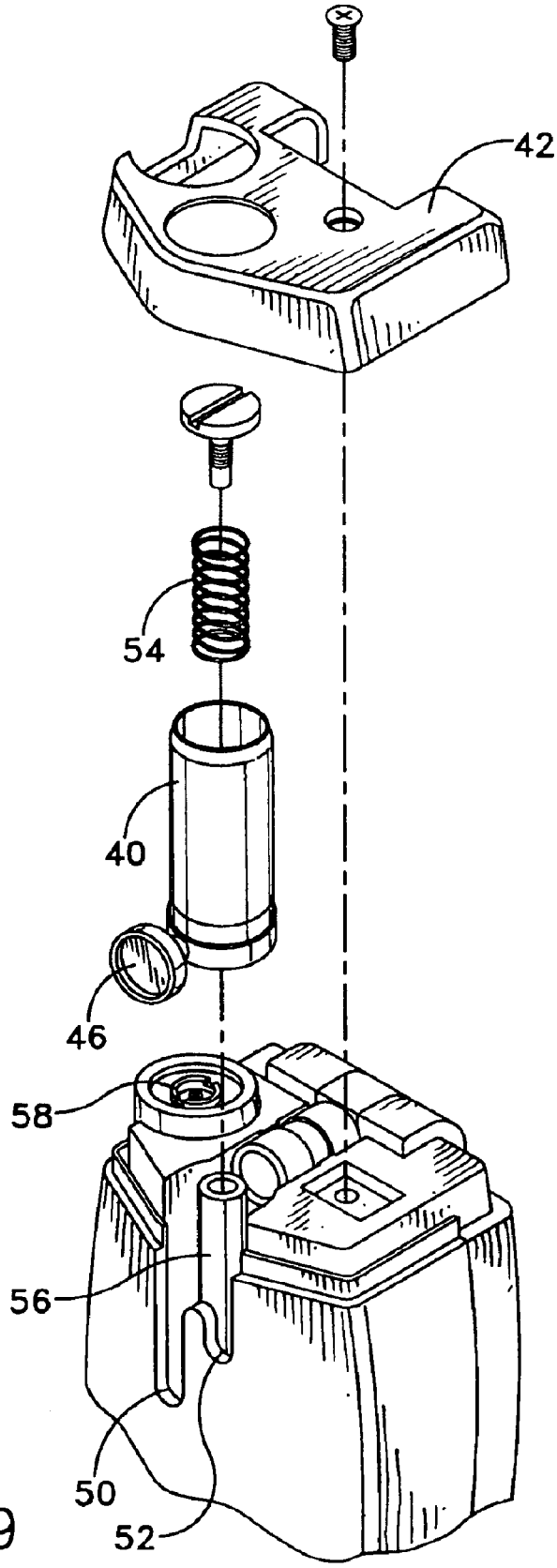
FIG. 9 is an exploded view of the second cutting assembly of FIG. 7.
Figure 10:
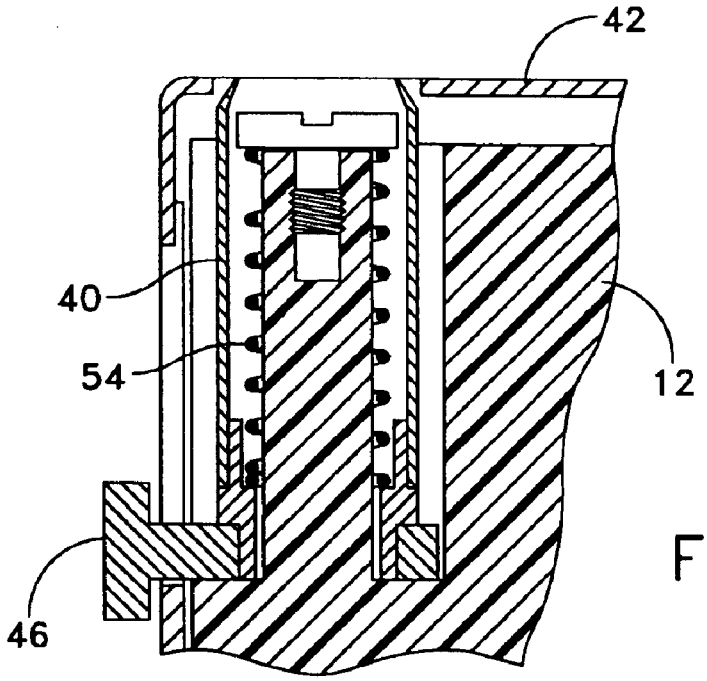
FIG. 10 is a cross-sectional view of the second cutting assembly in the retracted position, as taken along lines 10—10 of FIG. 7.
Figure 11:
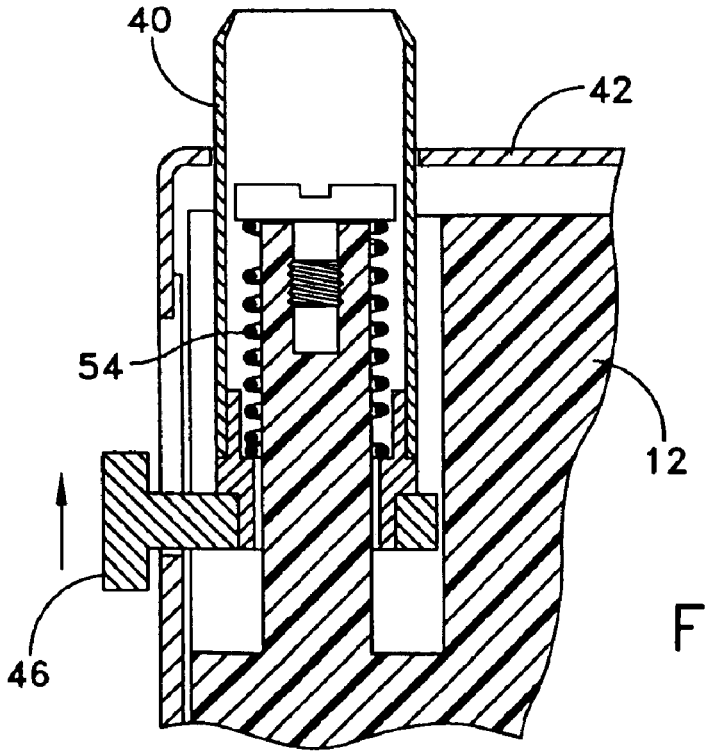
FIG. 11 is a cross-sectional view of the second cutting assembly in the actuated position as taken along lines 11—11 of FIG. 8.

Referring now to the Figures, there is generally indicated at 10 a combination lighter and cigar cutting device. The device 10 is especially suited for removing the finished head portion of a cigar 11 (FIGS. 6 and 12), for forming a tubular opening in the cigar, and lighting the cigar. The combination device 10 includes a lighter body 12 which supports a first cutting assembly 14 and a second cutting assembly 16 (FIG. 7). The body 12 also preferably houses a lighter mechanism for producing a flame, as is known in the art. The lighter mechanism may have any of a variety of configurations. In the present embodiment, the body 12 includes an interior cavity (not shown) which supports a container 18 for storing lighter fuel therein. A spark generating member (not shown) is also provided, as is known in the art, and which is activated in the present embodiment by a user moving switch 22 between a non-actuated position, and an actuated position. As the user moves the switch into the actuated position the spark generating member generates a spark, while also causing the fuel to be passed from the fuel container so that it can be lit by the generated spark, thus igniting a flame. The flame is emitted through an opening (not shown) disposed in a first or top end 24 of the housing, and will remain lit for as long as the lighter switch 22 remains actuated, or until a cover 26 is closed over the opening. In the present embodiment, cover 26 is preferably pivotally supported by the lighter body 12 such that it can be moved between an open position (not shown) where a flame can be ignited, and a closed position (FIG. 1) when the flame is extinguished and the lighter is not in use. Although an exemplary lighter mechanism is described, the present invention is not limited to a particular lighter mechanism, but is directed to a device 10 which in one common body supports a lighting mechanism and a first and a second cutting assembly.

Figure 2:
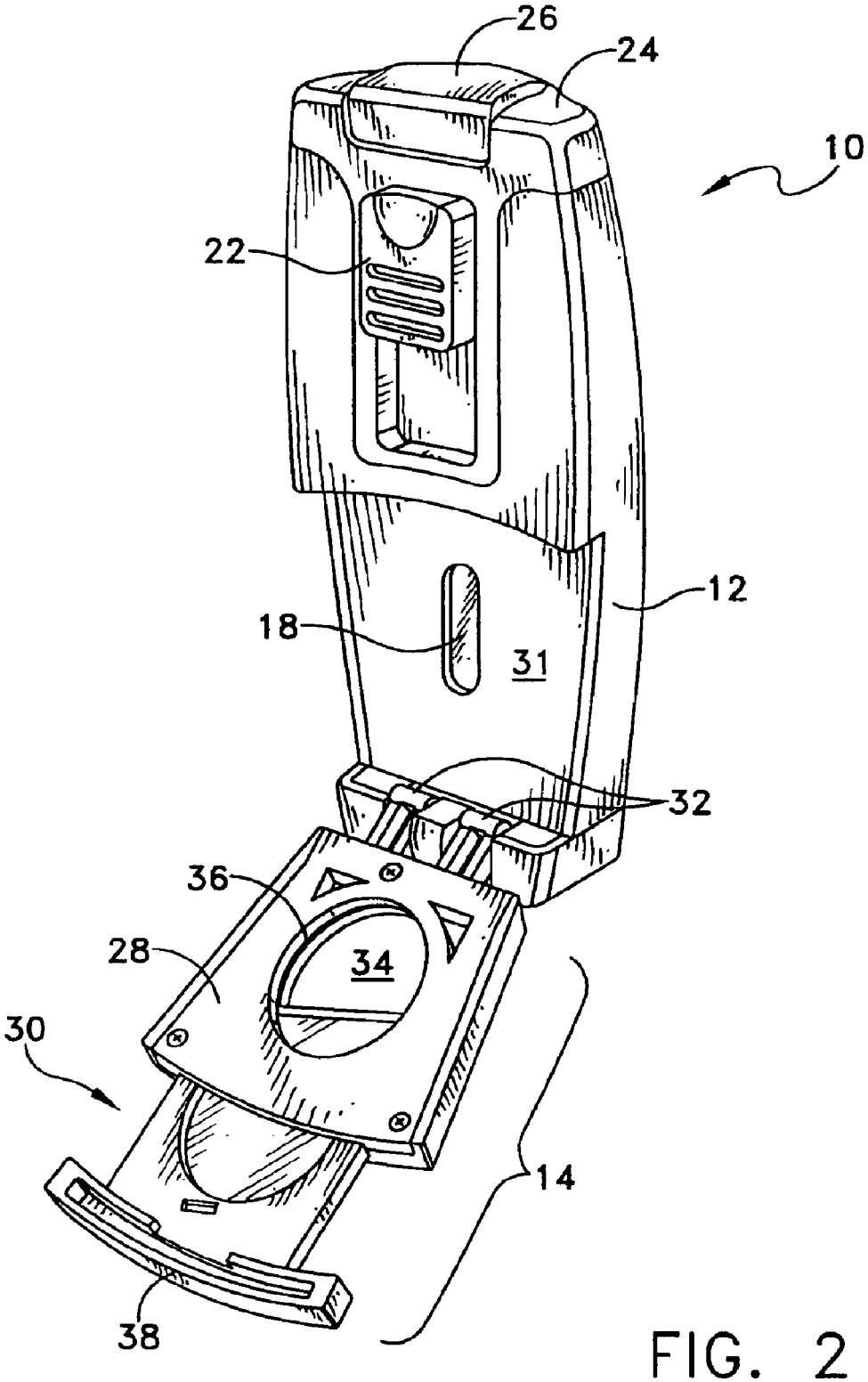
FIG. 2 is a perspective view of the embodiment of FIG. 1 with a first cutting assembly in an open position.
Figure 3:
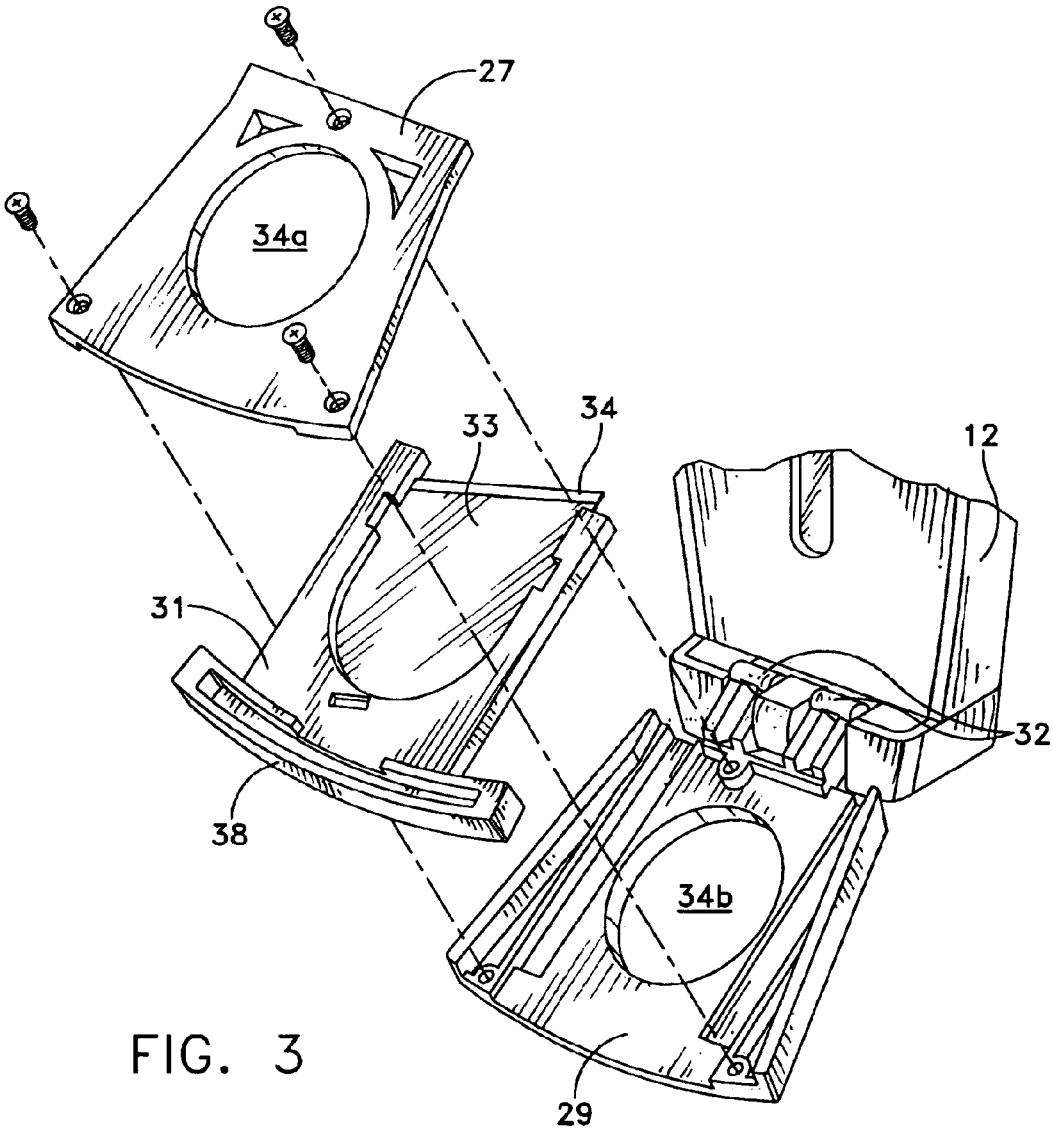
FIG. 3 is an exploded view of the first cutting assembly of FIG. 2.
Figure 4:
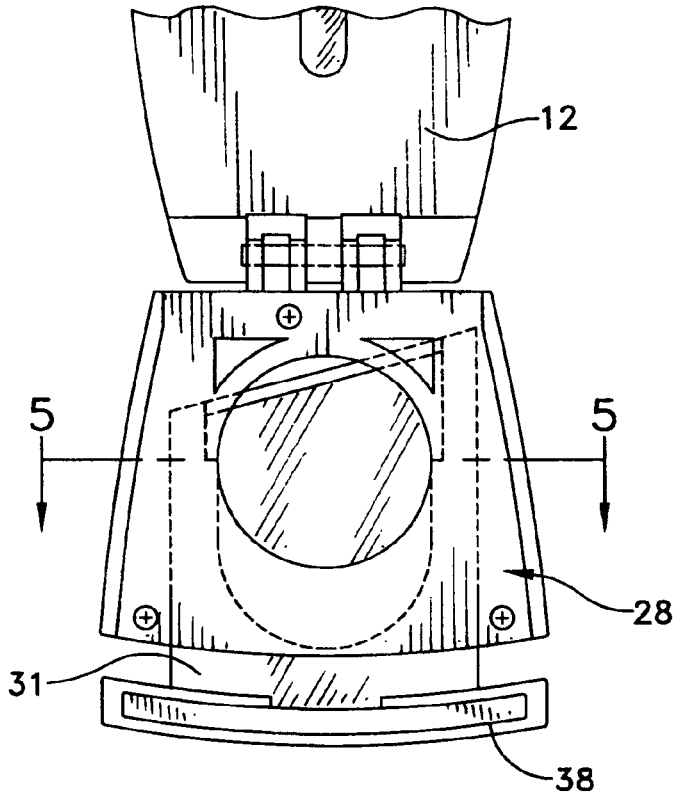
FIG. 4 is an enlarged view of the first cutting assembly of FIG. 2.
Figure 5:
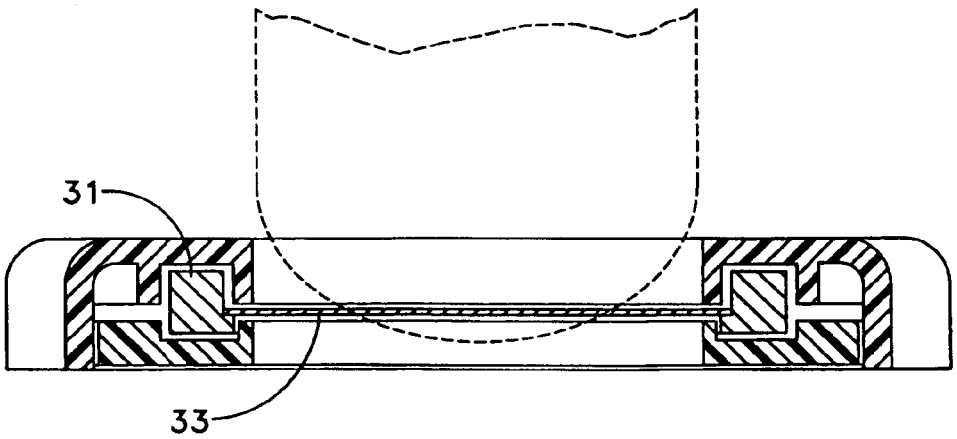
FIG. 5 is a cross-sectional view of the first cutting assembly taken along lines 5—5 of FIG. 4.

The body 12 further supports the first cutting assembly 14, for example a guillotine style cutter, as illustrated in the present embodiment. As shown most clearly in FIGS. 2 and 3, the guillotine style cutter includes a housing 28 which supports a moveable cutting blade assembly 30 therein. The housing 28 is preferably pivotally attached to the body 12 of the lighter, for example by hinge member 32, such that the housing is moveable between a closed position where the first cutting assembly is adjacent the body 12 (FIG. 1), and an open position where it extends from the body 12 (FIG. 2). The body 12 preferably has a cut-out portion 31 which forms a step-like configuration such that an outer surface 33 of the first cutting assembly lies substantially flat, i.e. substantially planar, with respect to an outer surface 35 of the body in the closed position. Alternatively, other methods of supporting the housing 28 so that it is moveable between the closed and open positions may be utilized, such as a slide mount or a bayonet-type mount, as would be known to those of skill in the art.

The housing 28 further includes an opening 34 sized to receive an end of a cigar therein, and a slot 36 sized to slidably receive cutting blade assembly 30. In the present embodiment, the housing 28 may include a face plate 27 secured to a rear plate 29, for example by fasteners, such that slot 36 is formed there between. Both the front and rear plate include corresponding openings 34*a*, 34*b* which together form opening 34. The cutting blade assembly 30 may preferably include a blade holder 31 for holding a cutting blade 33, and a handle 38 for moving the cutting blade. The cutting blade 33 includes a cutting edge 36, which may preferably be inclined. The handle 38 may be grasped by a user to move the cutting blade 33 between an outward position where the cutting edge 36 is spaced from the cigar, toward an inward position in contact with the cigar (FIG. 6), when the cigar is placed within opening 34. In the outward position the blade is substantially removed from within slot 36 such that opening 34 is accessible to receive one end of the cigar. The cutting blade may be removably supported within the blade holder, or may permanently secured therein. As will be appreciated, the first cutting member resembles a "guillotine" style assembly, such guillotine style cutters being known in the art.

Referring now to FIGS. 7–12, second cutting assembly 16 is also supported by body 12 of the lighter. In the present embodiment, the second cutting assembly 16 includes a punch-style cutter supported at a bottom end 42 of the lighter body 12, preferably opposite cover 26. Such punch-style cutters are also known in the art. The second cutting assembly 16 may have a tubular-shaped body 40 and includes a cutting end 44 designed to cut or punch a tubular opening into an end of the cigar. The assembly 16 may also be moveable between a retracted position wherein the cutting end 44 is substantially flush with bottom end 42, and an operative position where the cutting end and tubular body extend from within bottom end 42. In order to move the cutting end 44 between the retracted and operative positions, a knob 46 may be provided which extends from the tubular-shaped body 40 and through a slot 48 formed in the lighter body 12. The slot 48 may have a generally "u-shape" configuration, including a first end 50 where the knob is positioned in the retracted position, and a second end 52 where the knob is positioned and supported in the extended, or in-use position. A spring 54 may further be positioned between tubular body 40 and post 56 for normally biasing the cutter in the retracted position. A fill opening 58 may also be provided in bottom end 42 in order to refill the fuel contained within the body of the lighter, as is known in the art.

Figure 12:
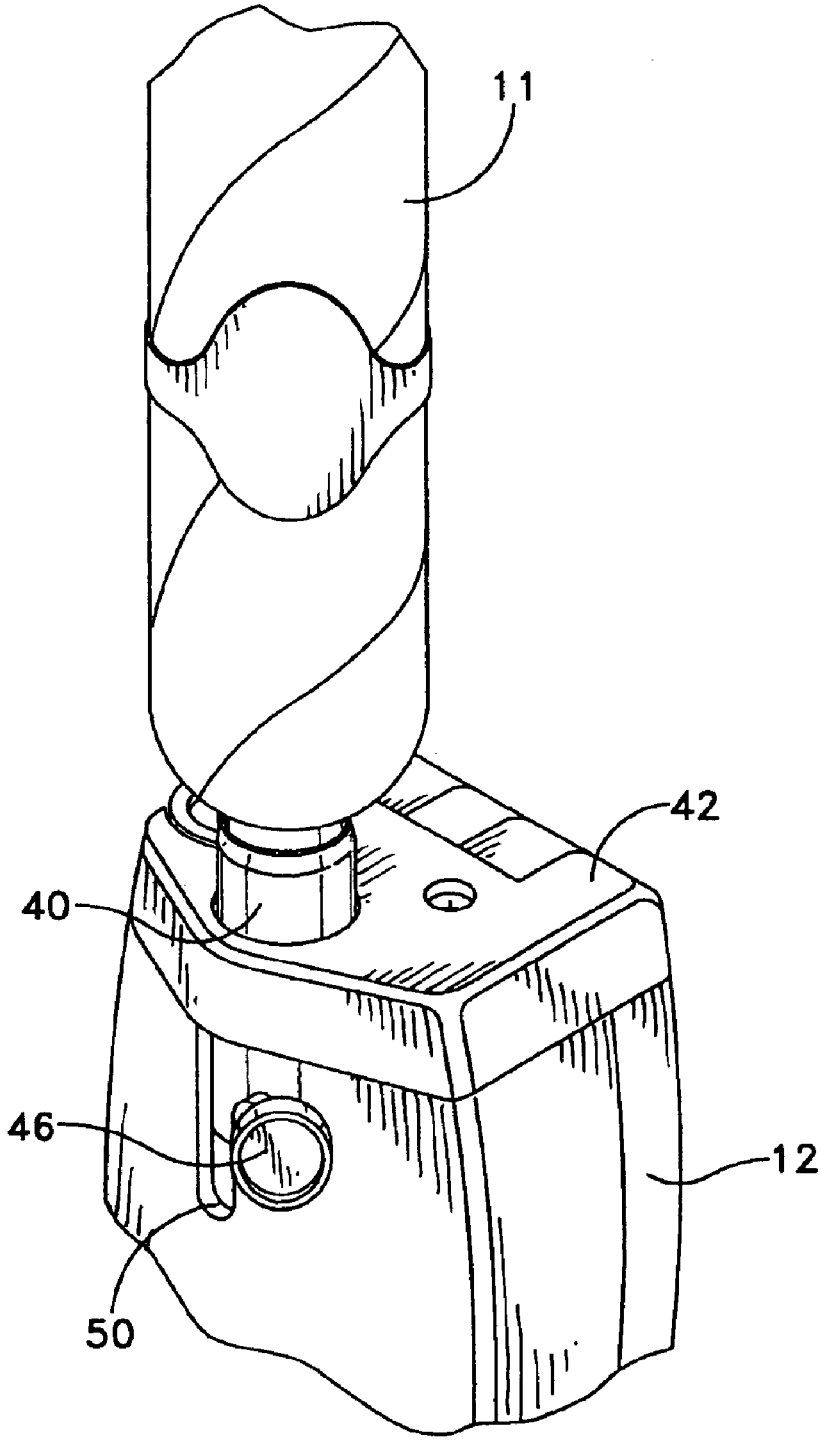
FIG. 12 is a perspective view of the second cutting assembly in use with a cigar.

Use of the combination lighter and cigar cutter will now be described with reference to the Figures. In use, the guillotine style first cutting assembly 14 may be moved from the closed position to the open position by the user grasping the sides of the housing 28 and rotating the assembly into the open position. The user may thereafter grasp the handle 38 and move the cutting blade 33 to the outward position where the cutting edge 36 is spaced from the cigar. Movement of the blade 33 into the outward position removes the blade from the portion of the slot covering the opening 34, such that the cigar can be placed within the opening. After the end of the cigar is placed within the opening 34, the blade can be moved by the user to a second position in contact with the cigar (FIG. 6), in order to sever the end of the cigar. In use, the punch style second cutting assembly 16 is activated by a user grasping knob 46 and moving it within slot 48 from the first end 50 to the second end 52 so that the cutting end is moved from the retracted position where it is substantially flush with the bottom end 42 of the body 12 and the operative or cutting position where it extends from within bottom end 42. Once knob is supported in the second end 52 of the slot so that the cutting end 44 is supported in the extended position, the user can insert the cutting end into the closed end of the cigar, so as to "punch" or cut a hole in the closed end of the cigar, as shown in FIG. 12.

It will be understood that various modifications may be made to the embodiment disclosed herein. Therefore, the above description should not be construed as limiting, but merely as exemplifications of a preferred embodiment. Those skilled in the art will envision other modifications within the scope, spirit and intent of the invention.

What is claimed is:

1. A combination lighter and dual cigar cutting assemblies for lighting and cutting a cigar comprising;

a lighter body constructed and arranged to support a lighting mechanism and including a first end having an opening constructed and arranged to accommodate a flame there through;

a first cutting assembly supported by the body and including a housing pivotally supported on the lighter body, and a moveable cutting blade assembly slidably disposed within the housing;

a second cutting assembly supported by the lighter body at a second end opposite the first end and including a tubular body portion having a cutting end constructed and arranged to cut a hole in a closed end of a cigar, the second cutting assembly being moveable between a retracted position wherein the cutting end is substantially flush with the second end of the lighter body, and an extended cutting position where the cuffing end extends from the second end of the lighter body;

a slot disposed within the lighter body and including a first end and a second end;

a knob extending from the tubular body portion and through the slot so that the knob can be grasped by a user; and wherein to support the second cutting assembly in the extended cutting position, the knob is moved from the first end of the slot, to the second end of the slot, the second end of the slot being constructed and arranged to support the knob and the tubular body portion in the extended position as the cutting end engages the cigar.

2. The combination of claim 1, wherein the slot has a generally u-shaped configuration.

3. The combination of claim 1, further comprising a spring positioned between the tubular body portion and a post, the spring constructed and arranged to normally bias the tubular body in the retracted position.

4. The combination of claim 1, further comprising a cover pivotally supported at the first end of the body and moveable between an open and a closed position.

5. The combination of claim 1, wherein the housing is pivotally supported on the body by a hinge member.

6. The combination of claim 1, wherein the first cutting assembly is moveable between a closed position where the first cutting assembly is adjacent the lighter body, and an open position where first cutting assembly extends from the lighter body.

7. The combination of claim 6, wherein the lighter body includes a cut-out portion forming a step-like configuration such that an outer surface of the first cutting assembly lies substantially planar with respect to an outer surface of the lighter body in the closed position.

8. The combination of claim 7, wherein the housing of the first cutting assembly further includes an opening sized to receive an end of the cigar therein, and a slot sized to slidably receive the cutting blade assembly.

9. The combination of claim 1, wherein the first cutting assembly includes a cutting edge and a handle constructed and arranged to be grasped by a user in order to move the cutting blade between an outward position where the cutting edge is spaced from the opening, and an inward position where the cutting edge engages an end of the cigar disposed within the opening.

10. A combination lighter and dual cigar cutting assemblies for lighting and cutting a cigar comprising;

a lighter body constructed and arranged to support a lighting mechanism and including a first end having an opening constructed and arranged to accommodate a flame there through, and further including a cut-out portion forming a step-like configuration;

a first cutting assembly supported by the lighter body and including a housing pivotally supported on the lighter body and moveable between a closed position where the first cutting assembly is adjacent the lighter body, and an open position where first cutting assembly extends from the lighter body, and a moveable cutting blade assembly slidably disposed within the housing;

a second cutting assembly supported by the lighter body at a second end, opposite the first end, and including a tubular body portion having a cutting end constructed and arranged to cut a hole in a closed end of a cigar, the second cutting assembly being moveable between a retracted position wherein the cutting end is substantially flush with the second end of the body, and an extended cutting position where the cutting end extends from the second end of the body;

a slot disposed within the lighter body and including a first end and a second end, the slot having a generally u-shaped configuration;

a knob extending from the tubular body portion and through the slot so that the knob can be grasped by a user; and wherein to support the second cutting assembly in the extended cutting position, the knob is moved from the first end of the slot, to the second end of the slot, the second end of the slot being constructed and arranged to support the knob and the tubular body portion in the extended position as the cutting end engages the cigar, and wherein an outer surface of the first cutting assembly lies substantially planar with respect to an outer surface of the lighter body in the closed position.

11. The combination of claim 10, further comprising a spring positioned between the tubular body portion and a post, the spring constructed and arranged to normally bias the tubular body in the retracted position.

12. The combination of claim 10, further comprising a cover pivotally supported at the first end of the body and moveable between an open and a closed position.

13. The combination of claim 10, wherein the housing is pivotally supported on the body by a hinge member.

14. The combination of claim 10, wherein the housing of the first cutting assembly further includes an opening sized to receive an end of the cigar therein, and a slot sized to slidably receive the cutting blade assembly.

15. The combination of claim 10, wherein the first cutting assembly includes a cutting edge and a handle constructed and arranged to be grasped by a user in order to move the cutting blade between an outward position where the cutting edge is spaced from the opening, and an inward position where the cutting edge engages an end of the cigar disposed within the opening.

* * * * *